US007032601B2

(12) United States Patent
Atchley et al.

(10) Patent No.: US 7,032,601 B2
(45) Date of Patent: Apr. 25, 2006

(54) ENCAPSULATED MATERIALS

(75) Inventors: Frank S. Atchley, Nashville, TN (US); Vernie A. Due, Nashville, TN (US); Thomas R. Gray, Murfreesboro, TN (US)

(73) Assignee: U.S. Smokeless Tobacco Company, Greenwich, CT (US)

( * ) Notice: Subject to any disclaimer, the term of this patent is extended or adjusted under 35 U.S.C. 154(b) by 0 days.

(21) Appl. No.: 10/255,238

(22) Filed: Sep. 26, 2002

(65) Prior Publication Data

US 2003/0070687 A1 Apr. 17, 2003

Related U.S. Application Data

(60) Provisional application No. 60/325,510, filed on Sep. 28, 2001.

(51) Int. Cl.
*A24B 15/00* (2006.01)

(52) U.S. Cl. ..... 131/352; 131/359

(58) Field of Classification Search ..... 131/352, 131/347

See application file for complete search history.

(56) References Cited

U.S. PATENT DOCUMENTS 4,001,438 A * 1/1977 Marmo et al. ..... 426/96
4,253,473 A 3/1981 Marmo et al.
4,515,769 A 5/1985 Merritt et al.
4,617,945 A 10/1986 Vos et al.
4,696,315 A 9/1987 Summers
4,715,390 A 12/1987 Nichols et al.
4,785,833 A * 11/1988 Holzner et al. ..... 131/310
4,969,955 A 11/1990 Rudin
4,975,270 A 12/1990 Kehoe
5,103,843 A 4/1992 Burger et al.
5,144,966 A 9/1992 Washington
5,186,185 A 2/1993 Mashiko et al.
5,417,229 A 5/1995 Summers et al.
5,432,154 A 7/1995 de Heij et al.
5,752,529 A 5/1998 Mane et al.
5,829,449 A 11/1998 Hersh et al.
6,079,418 A 6/2000 Russo
6,138,683 A 10/2000 Hersh et al.

FOREIGN PATENT DOCUMENTS

WO WO 98/15191 4/1998

* cited by examiner

*Primary Examiner*—Dionne A. Walls
(74) *Attorney, Agent, or Firm*—Fitch, Even, Tabin & Flannery

(57) ABSTRACT

The present invention is directed to an encapsulated material for use in chewable compositions. The encapsulated material is formed by blending an encapsulating solution with essential oils or other hydrophobic or amphipathic compounds flavoring solution to form a homogenous coating solution. The homogenous coating solution is contacted with a substrate to provide a flavored composition.

11 Claims, No Drawings

ENCAPSULATED MATERIALS

This application claims the benefit of U.S. Provisional Application No. 60/325,510, filed Sep. 28, 2001.

The present invention relates to encapsulated materials for use in chewable compositions such as chewing tobacco, pharmaceutical compositions and other orally utilized compositions. More particularly, the encapsulated materials of the present invention are used for coating substrates to provide a flavorant to the substrate.

BACKGROUND

There has been a considerable amount of work in the field of flavorant material for use in orally utilized compositions. It is often desirable to provide these flavorant materials in a form that is less volatile and in more stable, thus avoiding loss or degradation. A technique commonly employed in this regard, is the encapsulation of the active ingredient within a shell of a material designed to provide a complete coating around particles of the active ingredient. Such encapsulation procedures usually require the use of solutions or dispersions of the coating material, and the use of spray drying or drum drying procedures for the application of the coating material to the particles of interest (substrate).

Such procedures, however, are basically limited to being useful only with those types of coating materials which are readily soluble in one or more solvents and/or those coating systems which can be readily dried without subjecting the active ingredient to any adverse heat or stringent solvent conditions. Such prior art systems are, for the most part, not useful with elastomers. Further, such prior art encapsulation systems tend to be limited in terms of the length of time that they can delay or extend the release of the active ingredients, i.e., usually only over a period of up to about five to ten minutes, at most. Further, in many cases, where the active ingredient is released from such encapsulating agents it may only be released in a single burst of the active ingredient. Also, each of the prior art means available for encapsulating active ingredients tend to be limited, respectively, in terms of the active ingredients with which they can be used and/or with respect to the chewable products in which they can be employed.

One example of the use of encapsulated materials is the use of the encapsulated materials with smokeless tobaccos. Smokeless tobaccos are products that are orally consumed without subjecting the product to combustion. These products are manufactured in a variety of forms including chewing tobacco, dry snuff and moist snuff. Generally, these types of products are made as follows with the steps being in no particular order: cutting or grinding the tobacco into a suitable size; dipping or spraying the tobacco with a casing solution; partially drying the cased tobacco; holding the tobacco in containers for a period of time; and packaging it.

Chewing tobacco is typically sold in one of three forms: a "plug" where the tobacco is compressed into one of any number of shapes; "twists", where leaves are entwined into a rope-shaped product; and loose, leafy chewing tobacco where it is presented in an envelop-like container. Plugs typically have a moisture content around 15% or less by volume for "hard" plugs and greater than 15% for "soft" plugs. Twists and loose, leafy material are typically lower in moisture.

As stated previously, snuffs typically are marketed as either "dry" or "moist". Dry snuffs are generally finely ground, almost powdery, and typically have moisture contents around 8%. Moist snuffs, which typically have about 40 to 60% moisture content can have a variety of particle sizes depending on the product.

Some users of chewing tobacco and/or snuff compositions notice certain negative flavor characteristics associated with bitterness, astringency, acridness, tobacco flavor, and aftertaste. Chewing tobacco and snuffs are often treated with a variety of flavors to overcome the negative taste characteristics sometimes associated therewith.

Flavors that are added to tobacco products may be classified into two groups: a primary flavor as a casing sauce and a secondary flavor as a top flavor. Both kinds of flavors are generally added directly to the shredded tobacco by means of spraying during the preparation process of tobacco products.

Many of the flavors used with tobacco are volatile so that they readily diffuse. This volatility may result in unwanted aroma around where the product is stored and may effect the flavor of other products stored near the tobacco. Further, many flavors deteriorate during product preparation and subsequent product storage. Due to expected volatilization and deterioration tobacco products may be prepared with excess amounts of flavoring to compensate for the expected loss.

Hence, the need exists to provide an encapsualted material for coating substrates where these compositions are any orally utilized composition. Further, a need exists to provide a tobacco product and process for its preparation that minimizes flavor volatilization and deterioration.

SUMMARY

The present invention is directed to a chewing tobacco and/or snuff composition that includes encapsulated materials. As used herein, material shall mean essential oils or other hydrophobic or amphipathic compounds. The encapsulation process of the invention is effective for preventing volatilization, diffusion and deterioration of the encapsulated flavor. Upon chewing or dipping of the tobacco composition by a user, encapsulated flavors are released.

In another aspect of the invention, the encapsulation process and encapsulated materials can be used with any substrate. In this aspect, materials such as essential oils or other hydrophobic or amphipathic compounds can be added to any type of substrate, most importantly orally consumable substrates.

In an important aspect of the invention, encapsulated essential oils or other hydrophobic or amphipathic materials are provided by blending an encapuslating solution with essential oils or other hydrophobic or amphipathic materials to form a homogenous coating solution. Materials in the coating solution are encapsulated such that volatility and degradation of the flavor is diminished. The resulting homogenate may be contacted with a substrate, such as tobacco to form a flavored substrate, for example a flavored tobacco product coated with said material.

In accordance with the invention, an aqueous encapsulation solution is prepared from any hydroxyl containing compound effective for use in spray coatings and dextran or a dextran derivative, such as maltodextran, containing at least about 10 and no more than about 21 dextrose equivalents. Hydroxyl containing compounds suitable for use in the present invention include but are not limited to hydroxy propyl methylcellulose, sucrose, gelatin, modified, unaltered starched, and the like. In this aspect of the invention, the aqueous encapsulation solution has a solids concentration of about 60% or less and includes at least about 5 weight percent hydroxyl containing compound and at least about 5 weight percent dextran or dextran derivative. The percentages of hydroxyl containing compound and dextran or dextran derivative may be varied within these ranges to obtain desired coating characteristics.

In another aspect of the invention, a flavoring solution is prepared for blending with the encapsulating solution. The flavoring solution includes an essential oil or other hydrophobic or amphipathic material and a emulsifying agent. Emulsifying agents may be any of those capable of causing the essential oils or other hydrophobic or amphipathic material to suspend in an aqueous solution. Some examples of emulsifying agents include but are not limited to Tween or sodium lauryl sulfate or any other such emulsifying agents depending on the intended use of the encapsulated product. For example, encapsulated product for use as a food should use emulsifying agents that are acceptable for that industry. It is preferred that emulsifying agent be added to the essential oil, hydrophobic or amphipathic solution to a level whereby the essential oil, hydrophobic or amphipathic solution has a final concentration of emulsifying agent in a range of about 200 to about 400 ppm. A brief homogenization or sonication is typically sufficient to blend the emulsified solutions before integration into the encapsulating solution.

Encapsulating solutions and materials are blended in a manner effective for incorporating the material into the encapsulating solution to form a homogenous coating solution or substrate. In this aspect of the invention, the homogenous coating solution includes essential oil or other hydrophobic or amphipathic materials in an amount of at least about 0.5 weight percent of the homogenate and not more than about 40 weight percent of the homogenate.

DETAILED DESCRIPTION

The present invention is directed to a homogenous coating solution that can be applied to a chewing tobacco and/or snuff product to provide a flavored tobacco product. However, the invention is not limited to tobacco and can be used to coat any desired substrate. As used herein the term ▒substrate▒ includes but is not limited to tobacco, chewable vitamin, drugs, confectionary candies, gums, foods and other products where essential oils or other hydrophobic or amphipathic compounds are desired to be encapsulated to prevent degradation thereof and allows release upon dissolving in an aqueous solution. The flavored products of the present invention, including chewing tobacco and snuff products, have very little or no noticeable aroma resulting from the type of flavoring being used. The essential oils or other hydrophobic or amphipathic compounds of the present invention are encapsulated such that flavors do not drift to other products near the product. Upon ordinary chewing or dipping of the product, the user will release flavorings as hydration occurs.

The homogenous coating solution of the invention is a blend of an encapsulating solution and a essential oils or other hydrophobic or amphipathic compounds. The homogenous coating solution is sprayed onto a substrate to provide a substrate encapsualted product.

Encapsulating Solution

In accordance with the invention, an aqueous encapsulation solution is prepared of any hydroxyl containing material effective for use in spray coatings and dextran or a dextran derivative such as maltodextran. The solution should be brought to a temperature allowing for the dissolving of any solids in the solution. The temperature needed will depend on the solutions themselves and is easily observable by one having ordinary skill in the art. For most solutions, a temperature of about 60° C. for some period of time is sufficient to dissolve all solids. In an important aspect of the invention the encapsulating solution is a combination of maltodextran and sucrose.

Material Solutions

Flavors to be used in the present invention may not be limited particularly and almost every kind of flavor is applicable, among which powdery flavors and oily flavors are employed advantageously. Typical powdery flavors include but are not limited to licorice, kudzu, hydrangea, Japanese white bark magnolic leaf, chamomile, fenugreek, clove, menthol, Japanese mint, sage, aniseed, cinnamon and herb, etc., all powdered in a size of about 1 μm to 5 mm. Typical oily flavors include but are not limited to chocolate, wintergreen, cherry and berry type flavors, various liqueurs and liquors such as Dramboui, bourbon, scotch, whiskey, spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ilangilang, sage, fennel, piment, ginger, anise, coriander, coffee, and mint oils form any species of the genus Mentha. The genus Mentha includes but is not limited to those listed in the USDA, ARS, National Genetic Resources Program, Germplasm Resources Information Network—(GRIN), National Germplasm Resources Laboratory, Beltsville, Md. (www.ars-grin.gov/var/apache/cgi-bin/npgs/html/tax/taxlist.pl?Mentha). Examples of *Mentha aquatica, Mentha canadensis, Mentha cervina, Mentha japonica, Mentha logifolia, Mentha piperita, Mentha pulegium, Mentha spicata*, and *Mentha suaveolens.*

In an important aspect of the invention, the flavoring is an essential oil, such as mint oil. Mint oils useful in the present invention include spearmint and peppermint.

Homogenous Coating Solution

In another aspect of the invention, encapsulating and flavoring solutions are blended to form a homogenous coating solution. In this aspect of the invention, the encapsulating solution and the flavor solution are blended to reach a target flavor level in the final coating. The functional ranges of this blend are typically such that the essential oil or other hydrophobic or amphipathic material is not less than about 0.5% and not more than about 40% of the homogenate by weight. The encapsulation solution and the flavor solution are blended in an acceptable vessel for homogenization to occur and subjected to high speed sheer mixing until all of the flavor solution is completely incorporated into the encapsulation solution. Heating may be used to enhance blending.

Tobacco

In an important aspect, the tobacco used in the product of the present invention may be any tobacco known to be suitable for use as chewing tobacco or snuffs. Suitable tobaccos include fermented and unfermented tobaccos, air cured, burley, dark, dark-fired, flue cured, and cigar filler or wrapper as well as the products from the whole leaf stemming operation. Alternatives and variations include the use of tobacco leaf or lamina and stem. In addition, scrap size tobacco lamina may be commingled with homogenized product for the purpose of controlling the texture and flavor release during chewing or dipping. The tobacco used in the present invention may be mixed with other additives as known in the art.

Spray Coating

The actual process of spray coating will vary depending on the equipment used and the material being coated. Technology in the spray coating art is considerably diverse and allows for a multitude of equipment designs. Exemplary spray coating equipment manufacturer include Vector Corporation (Sloan, Iowa). This process can be adapted for use in the vast majority of these designs with minimal effort.

Temperature considerations must be factored into the process parameters to insure that essential oil or other hydrophobic or amphipathic material are not volatilized or degraded before the encapsulation process can occur. For instance, a spray drying temperature of about 60° C. would be acceptable and allow for adequate encapsulation of essential oils such as mint oil.

Fluidization of the substrate to be coated as well as the coating material also is a consideration to be taken into account. Air flows rates within the spray coating equipment must be such that the material remains suspended but not so great that it results in degradation of the substrate. The fluidization process differs greatly according to the given substrate due to particle size, shape, mass, density and composition. Another factor affecting fluidization of the substrate is the position of the spraying apparatus and it's attitude with regard to air flow. Currently in the spray coating art there are a great number of designs allowing for top spray, bottom spray, and any given angled application based on the specific needs of the coater. The air flow parameters needed to achieve this adequate coating are well within the experimental parameters easily performed by the skilled artisan.

The spray nozzle used to apply the coating can be any currently available nozzle which provides adequate atomization of the spraying solution and will most likely vary based on the equipment used to perform the coating. This particular coating process should be complete and have applied all of the coating solution within about 80 minutes from the time the coating solution application began. The resulting material will be granular in nature and free flowing.

The following examples illustrate methods for carrying out the invention and should be understood to be illustrative of, but not limiting upon, the scope of the invention which is defined in the appended claims.

EXAMPLES

Example I 8.0 Kg of aqueous solution was prepared comprising 30% sucrose, 30% maltodextrin, and 40% RO water. An essential oil mixture was prepared using 0.3 Kg of an essential flavor oil and 5 g of emulsifier (Tween 60). The aqueous solution and the essential oil mixture was blended and homogenized for 8 minutes at 12,500 rpm. The homogenate was then placed in the holding vessel to be spray coated on 10.0 Kg of substrate. The coating equipment used was a Vector MultiFlow-15 unit (Vector Corporation, Sloan, Iowa) which is a vertical fluidized bed. Coating was achieved using the following parameters;

| | |
|---|---|
| INLET AIR TEMPERATURE: | 60° C. |
| INLET AIR FLOW: | 300 CFM |
| SPRAY RATE: | 120 g/minute |

Numerous modifications and variations in practice of the invention are expected to occur to those skilled in the art upon consideration of the foregoing detailed description of the invention. Consequently, such modifications and variations are intended to be included within the scope of the following claims.

What is claimed is:

1. A chewing tobacco and/or snuff composition comprising tobacco encapsulated with an encapsulating material, wherein the encapsulating material is a homogenous blend of an encapsulating solution and essential oils or other hydrophobic or amphipathic compounds, wherein the encapsulating solution comprises a blend of a hydroxyl containing compound and a dextran or dextran derivative.

2. A chewing tobacco and/or snuff composition according to claim 1 wherein the encapsulating solution comprises a blend of a hydroxyl containing compounds effective for use in spray coatings and a dextran or dextran derivative.

3. A chewing tobacco and/or snuff composition according to claim 1 wherein the hydroxyl containing compound is selected from the group consisting of hydroxy propyl methylcellulose, sucrose, gelatin, modified, unaltered starched, and mixtures thereof.

4. A chewing tobacco and/or snuff composition according to claim 3 wherein the hydroxyl containing compound is sucrose.

5. A chewing tobacco and/or snuff composition according to claim 1 wherein the dextran derivative is maltodextran.

6. A chewing tobacco and/or snuff composition according to claim 1 wherein the encapsulating solution has a solids content of 60 weight percent or less.

7. A chewing tobacco and/or snuff composition according to claim 1 wherein the encapsulating solution has at least about 5 weight percent hydroxyl containing compound and at least about 5 weight percent dextran or dextran derivative.

8. A chewing tobacco and/or snuff composition according to claim 1 wherein the essential oils or other hydrophobic or amphipathic compounds are blended with an emulsifying agent.

9. A chewing tobacco and/or snuff composition according to claim 8 wherein the essential oil is a mint oil from any species of the genus *Mentha*.

10. A chewing tobacco and/or snuff composition according to claim 9 wherein the essential oil is spearmint.

11. A chewing tobacco and/or snuff composition according to claim 9 wherein the essential oil is peppermint.

* * * * *

UNITED STATES PATENT AND TRADEMARK OFFICE

CERTIFICATE OF CORRECTION

PATENT NO. : 7,032,601 B2
APPLICATION NO. : 10/255238
DATED : April 25, 2006
INVENTOR(S) : Frank S. Atchley et al.

It is certified that error appears in the above-identified patent and that said Letters Patent is hereby corrected as shown below:

Title page, (56) References Cited, line 13: after "5,432,154A delete "7/1995" and insert --6/1995--, therefor.

Column 6, line 15: delete "material" and insert --materials--, therefor.

Column 6, line 16: delete "material" and insert --materials--, therefor.

Column 6, line 20: delete "compound and" and insert --compounds--, therefor.

Signed and Sealed this

Twenty-ninth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,032,601 B2
APPLICATION NO. : 10/255238
DATED : April 25, 2006
INVENTOR(S) : Frank Scott Atchley, Vernie A. Due and Thomas Gray It is certified that error appears in the above-identified patent and that said Letters Patent is hereby corrected as shown below:

Column 6, line 15, claim 1: delete “materials” and insert --material-- therefor.
Column 6, line 16, claim 1: delete “materials” and insert --material-- therefor.
Column 6, line 20, claim 1: delete “compounds” and insert --compound and-- therefor.
Column 6, line 25, claim 2: delete “compounds” and insert --compound-- therefor.

Signed and Sealed this

Fifteenth Day of July, 2008

JON W. DUDAS
*Director of the United States Patent and Trademark Office*